US010111511B1

(12) United States Patent
Berard

(10) Patent No.: US 10,111,511 B1
(45) Date of Patent: Oct. 30, 2018

(54) FRAGRANCE TESTING STATION

(71) Applicant: Scentisphere LLC, Carmel, NY (US)

(72) Inventor: James Berard, Pleasantville, NY (US)

(73) Assignee: Scentisphere LLC, Carmel, NY (US)

( * ) Notice: Subject to any disclaimer, the term of this patent is extended or adjusted under 35 U.S.C. 154(b) by 184 days.

(21) Appl. No.: 15/298,727

(22) Filed: Oct. 20, 2016

Related U.S. Application Data

(60) Provisional application No. 62/245,517, filed on Oct. 23, 2015.

(51) Int. Cl.
*A45D 34/04* (2006.01)
*A45D 34/00* (2006.01)

(52) U.S. Cl.
CPC ..... *A45D 34/041* (2013.01); *A45D 2034/005* (2013.01)

(58) Field of Classification Search
CPC ..... A45D 34/041; A45D 2034/005; A45D 34/04; A45D 34/00; A45D 40/26; A45D 40/261; B05C 1/08; B05C 17/02; B05C 17/0245
See application file for complete search history.

(56) References Cited

U.S. PATENT DOCUMENTS 2,613,382 A * 10/1952 Patterson ..... A45D 34/041 401/214
2,719,314 A * 10/1955 Taube ..... A45D 34/041 401/214
4,571,106 A * 2/1986 Scuderi ..... A45D 34/041 215/382
5,810,495 A * 9/1998 McAuley ..... A45D 34/041 401/213
5,861,440 A * 1/1999 Gohla ..... A61K 8/345 424/400
9,370,233 B2 * 6/2016 Jung ..... A45D 34/041

* cited by examiner

*Primary Examiner* — David Walczak
(74) *Attorney, Agent, or Firm* — Levine Mandelbaum PLLC

(57) ABSTRACT

A fragrance testing station at which shoppers in a store can experience, by applying directly to their skin, a sampling mixture having the scent of a liquid fragrance product and contained in a reservoir mountable on a store fixture and having a roller on the bottom of the reservoir for being coated by the mixture under force of gravity. A high viscosity additive in the sampling mixture prevents leakage from a space between the reservoir and roller. The roller can be rotated for transferring a coating of the sampling mixture to the skin of a shopper for experiencing the scent of the liquid fragrance product in the sampling mixture. Multiple reservoirs may be mounted side by side for comparing different fragrance products.

12 Claims, 21 Drawing Sheets

FRAGRANCE TESTING STATION

BACKGROUND OF THE INVENTION

The present invention is a fragrance testing station at which an alcohol based fragrance product such as a perfume, cologne, eau de toilette (EDT), or the like can be sampled for use at a point of purchase in a retail store.

The most critical moment of a consumer's purchasing decision is at the point of sale. Studies have shown that 81% of consumers would choose a product they could smell and see over one they could only see; 88% of women buy a fragrance for the smell; 72% of consumers said that testing fragrances helps in their buying decision; 84% of consumers have said a scent activation device enhanced a store's image; 67% of consumers said that a fragrance tester would make them "much more likely" to purchase the product.

It is known in the art to provide at a retail point of purchase a sample of alcohol based fragrance liquid product for testing or sampling by a potential customer before selecting and purchasing the product. A bottle containing a quantity of the alcohol based fragrance liquid, sometimes equipped with an atomizer, may be provided at a cosmetics counter attended by a sales associate. Alcohol based fragrance liquid from the bottle may be applied to the skin of the customer in much the same way as the actual product is used after purchase.

The customer may spray a sample of the alcohol based fragrance liquid on the skin, usually on the hand or wrist, and then experience the fragrance by sniffing the site of application. Traditional spray testers are impractical for sampling alcohol based fragrance liquids in an unattended environment. They are expensive, do not last long, become unattractive when less than half filled, are vulnerable to pilferage, can harm customers if sprayed in the eyes, can damage in-store fixtures and surrounding products, and make it difficult to test more than one or two scents at a time due to spray pattern and dosage.

The provision of bottles containing alcohol based fragrance liquid for sampling must be limited to an attended display and supervised by a sales associate in order to prevent pilferage or contamination of the alcohol based fragrance liquid. Sprays also contaminate the air breathed by other consumers. The use of multiple sprays can result in cross contamination of scents to be sampled.

It is also known to apply alcohol based fragrance liquid products by using roll-on devices wherein the alcohol based fragrance liquid is stored in a reservoir having an opening on one end in which an applicator ball is rotatably mounted. The rotatable ball, when rolled over the skin of a consumer, picks up a quantity of the alcohol based fragrance liquid within the reservoir and transfers it to the skin. A spring may be provided to urge the ball against a rim surrounding the opening to prevent more than the amount that adheres to the surface of the ball from exiting the reservoir. Such roll-on devices are normally stored upright with a cap over the roller ball so that leakage during idle periods is avoided.

It is further known in the art to employ reservoirs superficially similar in construction to the above described roll-on applicators in that they have a spring loaded rotatable ball at one end for administering water to pets and other animals in a cage or other animal environment where water must be administered in the absence of an attendant or caretaker. With such feeding devices, the animal is able to exert pressure with its tongue on the ball against the force of a spring to move the ball into the reservoir thereby creating a space between the ball and normally engaged rim against which the ball is urged for enabling water to pass from the reservoir through a space between the ball and side wall of the reservoir for drinking by the animal. Such devices are unsuitable for dispensing alcohol based fragrance liquid in the limited quantities needed to allow rapid and complete evaporation of liquid from the skin with the scent of the alcohol based fragrance liquid left on the skin.

Testing or sampling of alcohol based fragrances (e.g., eau de toilettes, cologne's, etc.) in mass retail chains has been a very difficult challenge for fragrance marketers with no truly effective, low cost solutions. Testing fragrances at point of sale is very important, otherwise consumers will not know if they like a scent or not. Providing tester bottles is the traditional method of testing fragrances. However, tester bottles are expensive, very prone to theft, and can cause damage to surrounding products in the store when the scent is sprayed. An alternative method of testing is put small stickers on the products. Stickers for sampling alcohol based fragrance liquids provide only a rendition of the product. They can appear unattractive if scratched many times when attached to a product thereby increasing the likelihood of damages and returns. Moreover, they are only good for a few activations.

Prior to the present invention, there was no truly effective method available to test fine fragrances in a mass distribution environment. Because of this, the fine fragrance market in mass distribution is largely undeveloped. Consumers who can't sample fragrances in-store are resistant to buying a fragrance they haven't smelled. They must first experience the scent elsewhere, such as in a department store, magazines, or on someone else. This means that fragrance sales in mass distribution are driven by sampling and awareness methods performed elsewhere. Inability to test an actual alcohol based fragrance liquid inhibits opportunities to grow brands organically in mass distribution.

U.S. Pat. No. 2,613,382 to Patterson for a Liquid Dispensing Device Having a Globular Combined Applicator and Outlet Valve teaches a perfume dispenser having a roller ball mounted on an opening at one end of the dispenser. The ball is rotatable in a felt or similar material which absorbs the perfume stored in a reservoir within the dispenser. A spring urges the felt material against the ball which in turn forces the ball against the opening thereby sealing the opening from leakage. When filled with an alcohol based fragrance liquid and in a vertical disposition with the roller ball at the bottom, this type of device will leak and must be capped. Accordingly, there is no teaching in the patent to mount the dispenser on a fixture with the ball at the bottom of the dispenser.

Similar to the device of the '382 patent is one disclosed in U.S. Pat. No. 2,719,314 to Taube for a Perfume Dispenser. Taube's perfume dispenser has a ball urged by a spring against an opening in the device. Again no apparatus for mounting the dispenser in an inverted position is disclosed.

U.S. Pat. No. 5,810,495 to McAuley for a Narrow Line Applicator also discloses a roll-on liquid applicator having a ball which is urged by a spring against an opening in a container having a liquid to be applied by the ball. This applicator features a valve for controlling the quantity of liquid dispensed by the applicator.

U.S. Pat. No. 6,179,505 to Oder, III et al. for a Venting Roll-On Applicator discloses a roller ball applicator which allows for gases to be vented from the device.

U.S. Pat. No. 6,390,022 to Eichler et al. for an Animal Watering Apparatus discloses a device which is mounted on an animal cage for dispensing water to the animal.

U.S. Pat. No. 6,435,134 discusses prior art watering devices for animals.

Another animal watering device is disclosed in U.S. Pat. No. 6,561,129 to Cheng for a Pet Drinking Device Provided with In-Cage and Out-Cage Spouts for Drinking Water. This device is also one where a pet may lick a ball to dispense the water from a container mounted on a cage.

Prior art pet beverage dispensers do not dispense alcohol based liquids. Alcohol is very volatile and will drip or evaporate in a pet beverage dispenser. These water dispensing devices do not prevent or address dripping which is an inherent side effect with this type of device (pets will spill water when they drink from this device). Therefore the pet beverage art doesn't apply.

None of the roller ball devices of the prior art can prevent dripping and evaporation of alcohol based products to the degree required for use in a retail environment in the manner described.

SUMMARY OF THE INVENTION

The present invention overcomes the aforementioned problems of the prior art by providing a fragrance sampling device in a mass market unattended environment for testing the scent of alcohol based fragrance liquid by applying the alcohol based fragrance liquid to the skin in much the same way as is done when the alcohol based fragrance liquid in a purchased supply is used.

The present invention is a fragrance testing station for enabling consumers to sample an alcohol based fragrance product at a point of sale display. Alcohol based fragrance liquid is housed in a container with a roller ball at one end. The roller ball is urged against a flange in a neck of the container by a spring to prevent leakage when the sampling device is mounted in an inverted position, i.e., with the ball on the bottom and the opposite closed end of the container on top.

The present invention is unique because none of the prior art addresses or speaks to the dispensing of alcohol based perfumes, colognes, eau de toilettes, etc. using a roller ball package that is in a permanent inverted position for the sake of testing fragrances in retail or other environments.

The present invention prevents dripping of an alcohol based formula while the package is in a permanent inverted and uncapped position. The prior art cannot prevent dripping under the foregoing circumstances. Dripping cannot be tolerated because the alcohol and fragrance oil based solution will damage surrounding products and retail fixturing. If dripped on the floor the fragrance oil in the formula would make the floor slippery creating a liability to the retailer. The present invention specifically addresses this concern.

The present invention utilizes a roller ball applicator that dispenses a small dosage of the actual alcohol based fragrance when the ball is touched. The roller ball package is securely enclosed within a display housing that can be attached to an in-store shelf or any other point of sale fixture. The display housing encasement holds the bottle in place in an inverted position with the roller ball proximate a floor of the store and a top of the reservoir, opposite the bottom of the reservoir where the roller ball is contained, distal from the floor, and protects the roller ball from theft.

The roller ball applicator of the invention has a spring inside the reservoir housing in which the roller ball is rotatably mounted. This spring presses the ball against a flange, which creates a tight seal that helps prevent leakage and evaporation of the alcohol based product inside. However, as spring pressure alone may not be sufficient to completely avoid leakage, the invention employs a mixture of the scented alcohol based fragrance with a high viscosity additive to form a sampling mixture which is not able to pass through the narrow space between the rollers ball and reservoir housing when the ball pressed by the spring.

This specific roller ball package is essential to the sampler due to the volatility of the alcohol based formula. Stock roller ball packaging is much more economical than using tester bottles, and because it dispenses a very small amount of product, the roller ball tester lasts longer than a traditional spray tester bottle. The roller ball dispenser can be easily swapped out for a new bottle giving the display a long shelf life. Another salient feature of the invention is that because the product formula is alcohol based, it remains hygienic.

It is therefore an object of the invention to turn mass retailers into destination shops for fine fragrances through the use of a display unit that is interactive, engaging and informative.

Another object of the invention to be able to dispense real eau de toilette (EDT) product, not a fragrance rendition.

Still another object of the invention to provide a long lasting sampler for alcohol based fragrance liquids.

A further object of the invention is to dispense a small, controlled dosage of an alcohol based fragrance liquid so that customers can sample many different fragrances on-skin, which is the preferred method of testing fragrances, without overwhelming the senses, or others near them.

Still a further object of the invention is to provide a clean, safe and antibacterial testing system wherein fragrances do not cross contaminate.

An additional object of the invention is to provide a display system which offers many diverse merchandising options and is scalable so that it can be upsized or downsized based on store volume.

Still an additional object of the invention is to provide a sampler which efficiently tests many scents without taking up valuable retail space Another object of the invention is to provide a display system which features graphic display panels for visual, branded graphics.

Still another object of the invention is to provide a display system which encourages testing and sales of lesser known brands A further object of the invention is to provide a self sampling environment which is appealing to younger shoppers who may be intimidated by having to ask sales people for assistance.

Still a further object of the invention is to provide a tester unit which can be embellished with design elements unique to a retailer.

Still a further object of the invention is to help mass retailers to become proactive in launching and promoting prestige fragrances An additional object of the invention is to expand the fragrance market by attracting and educating consumers, who don't have access to specialty or department stores, about fine fragrance.

Still an additional object of the invention is to provide a fragrance sampler which is easily updatable, ensuring there is always something new, thereby encouraging customers to revisit the fragrance area.

DESCRIPTION OF THE PREFERRED EMBODIMENTS

Figure 1:
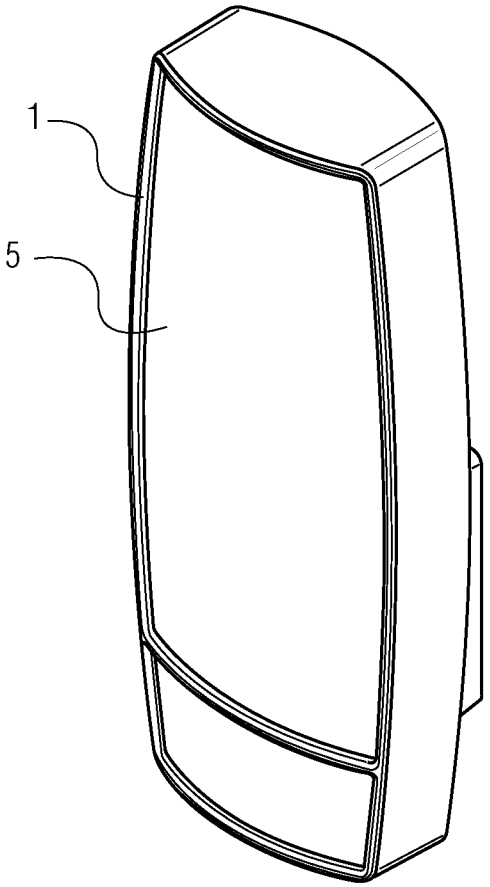
FIG. 1 is a perspective view of a fragrance sampler in accordance with a first preferred embodiment of the invention.
Figure 2:
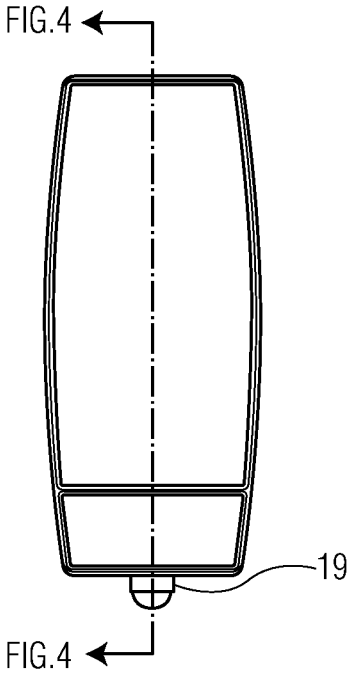
FIG. 2 is a front elevation view of the first preferred embodiment of the invention
Figure 3:
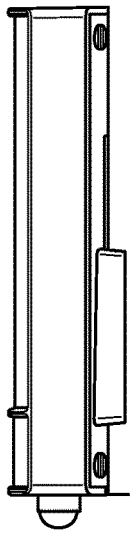
FIG. 3 is a side elevation view of the first preferred embodiment of the invention
Figure 4:
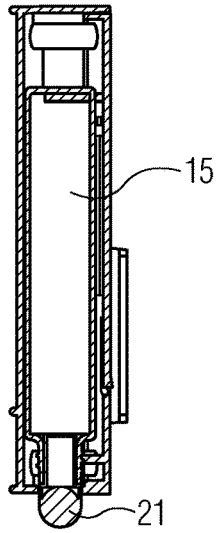
FIG. 4 is a sectional view of the first preferred embodiment of the invention taken through line 4-4 of FIG. 2.
Figure 5:
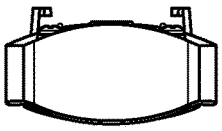
FIG. 5 is a top plan view of the first preferred embodiment of the invention.

Illustrated in the drawings are two functionally similar fragrance samplers for use in a fragrance testing station which differ primarily in aesthetics. There are slight differences in mounting of the components as will be appreciated from a comparison of the drawing figures. Also shown are fragrance testing stations with a plurality of fragrance samplers side-by-side.

Referring now to FIGS. 1-5, a first embodiment of a fragrance testing station in accordance with the invention includes a display housing 1 which is adapted to be mounted on a shelf or other fragrance liquid product display or storage structure at a point of purchase. The display housing 1 has a removable back plate or cover 3 which is preferably formed from an injection molded plastic, and a rectangular box-shaped shell which is also preferably injection molded and permanently closed at its front and open at its back when the back plate 3 is separated from the shell 5.

Figure 6:
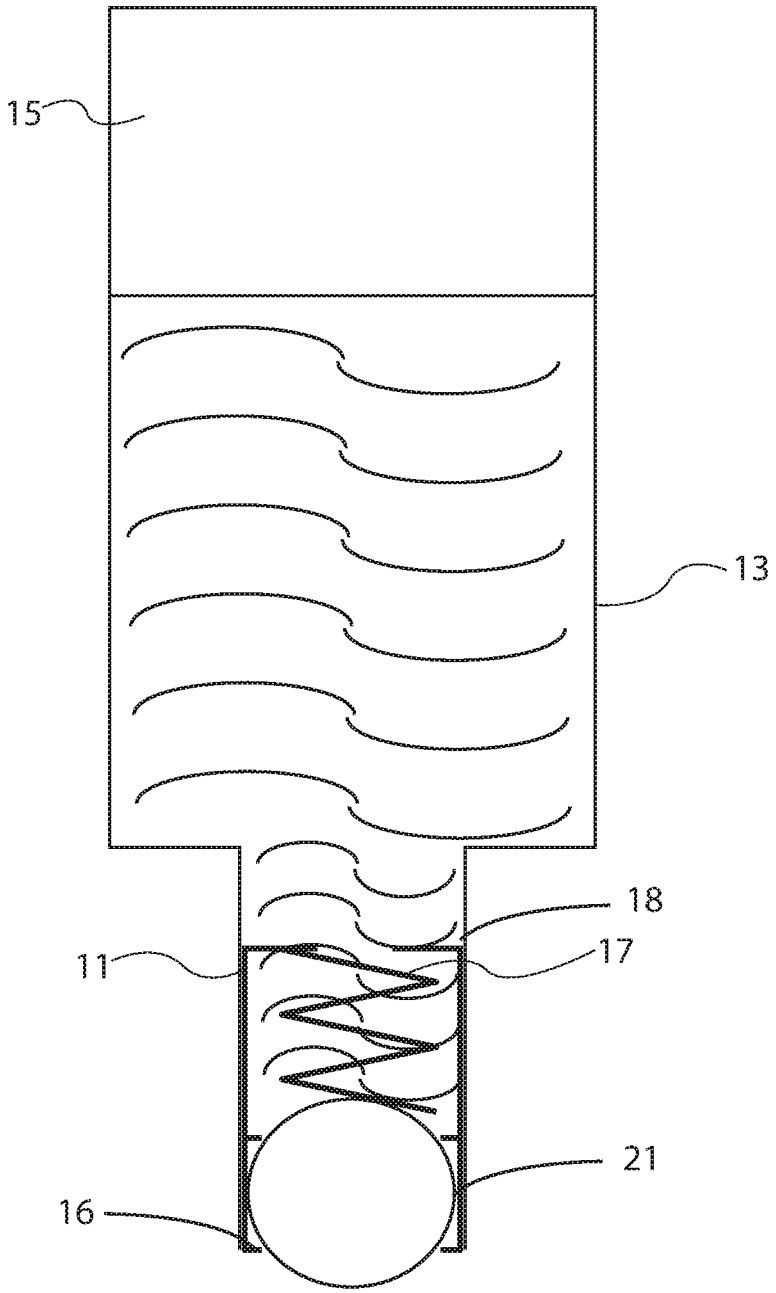
FIG. 6 is a schematic elevation view of a fragrance sampler of the type used in the invention.
Figure 7:
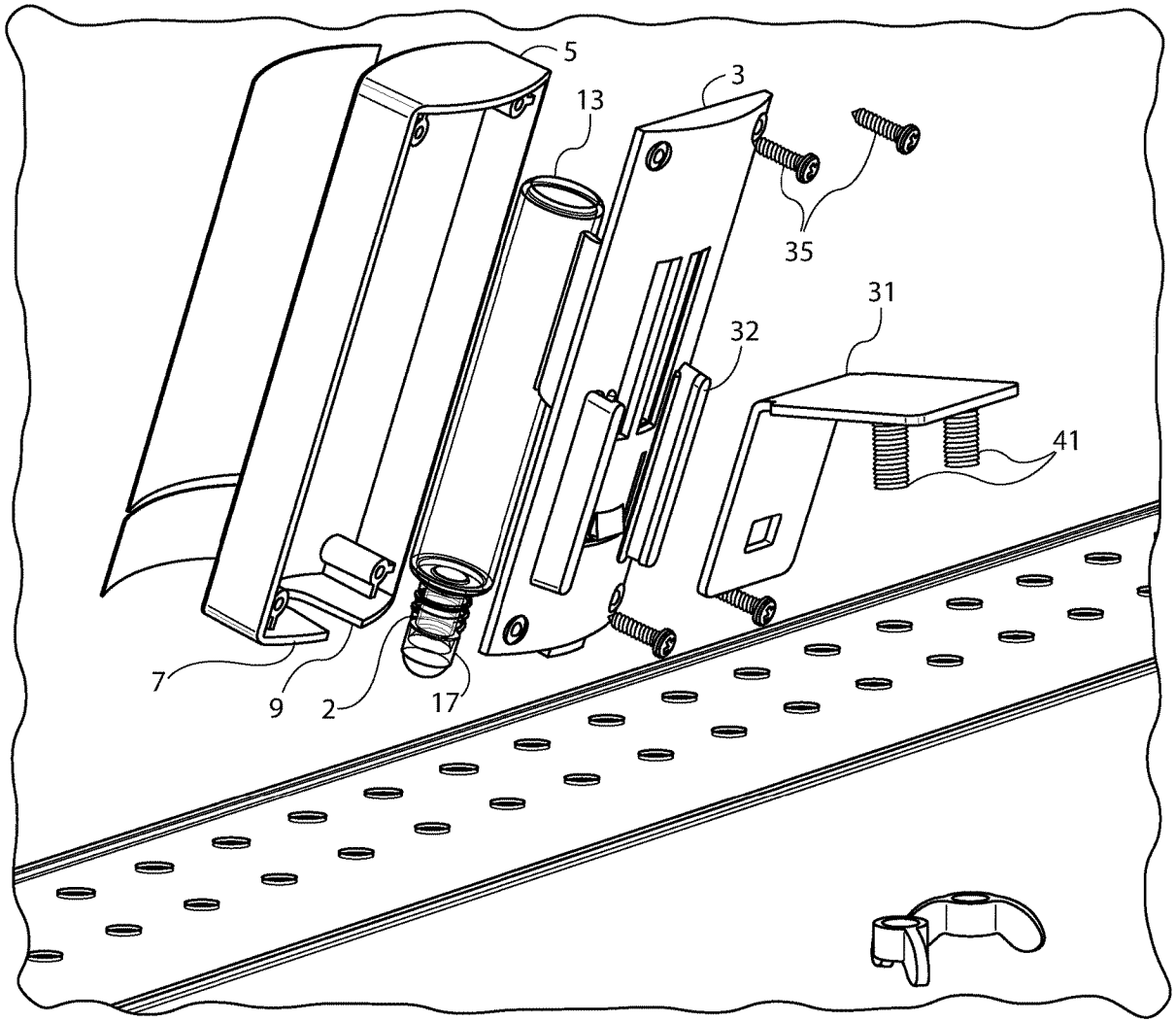
FIG. 7 is an exploded perspective environmental view of a fragrance sampler in accordance with the first preferred embodiment of the invention.
Figure 8:
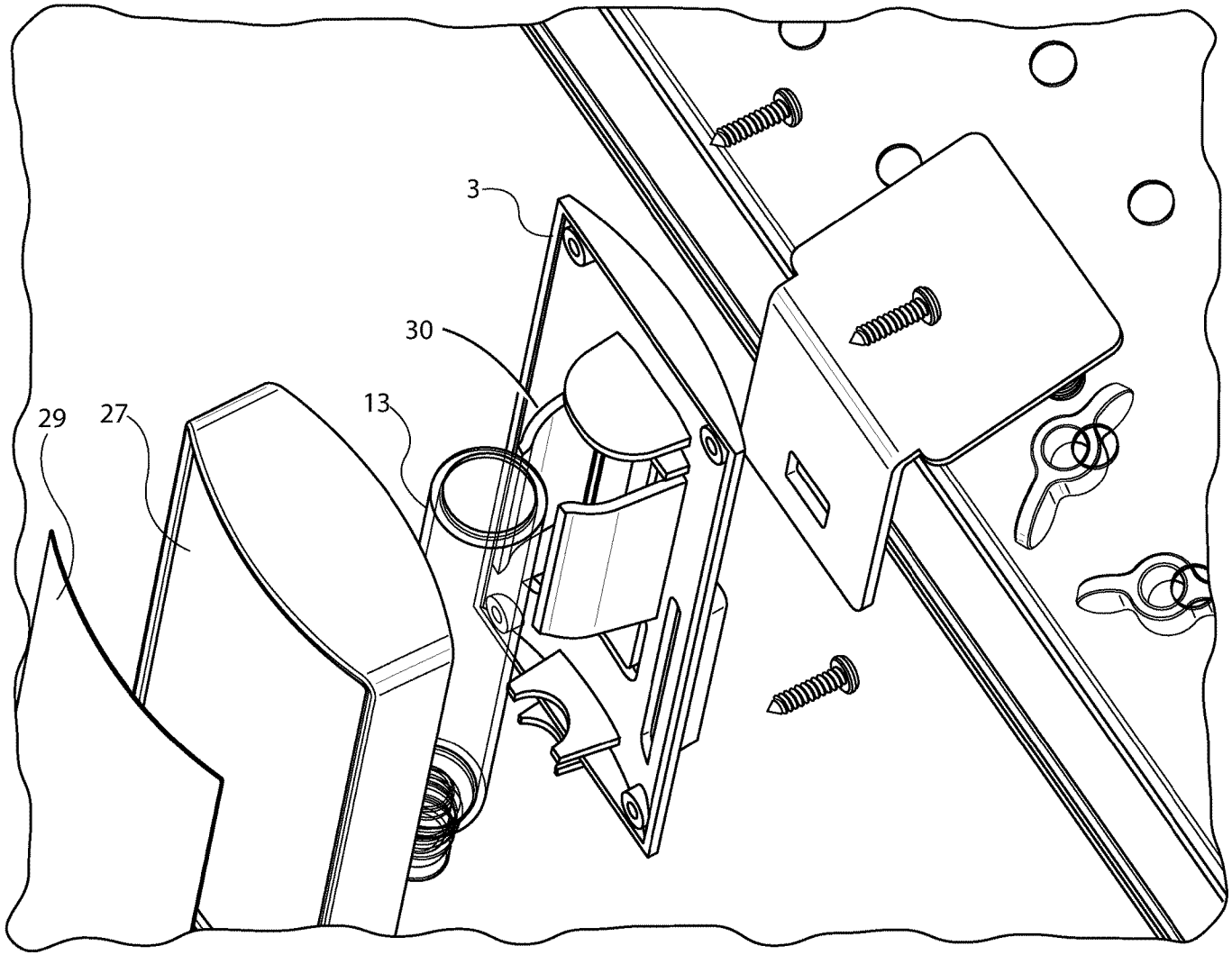
FIG. 8 is an enlarged exploded perspective environmental view of a fragrance sampler in accordance with the first preferred embodiment of the invention viewed from a direction different than that of FIG. 6.
Figure 9:
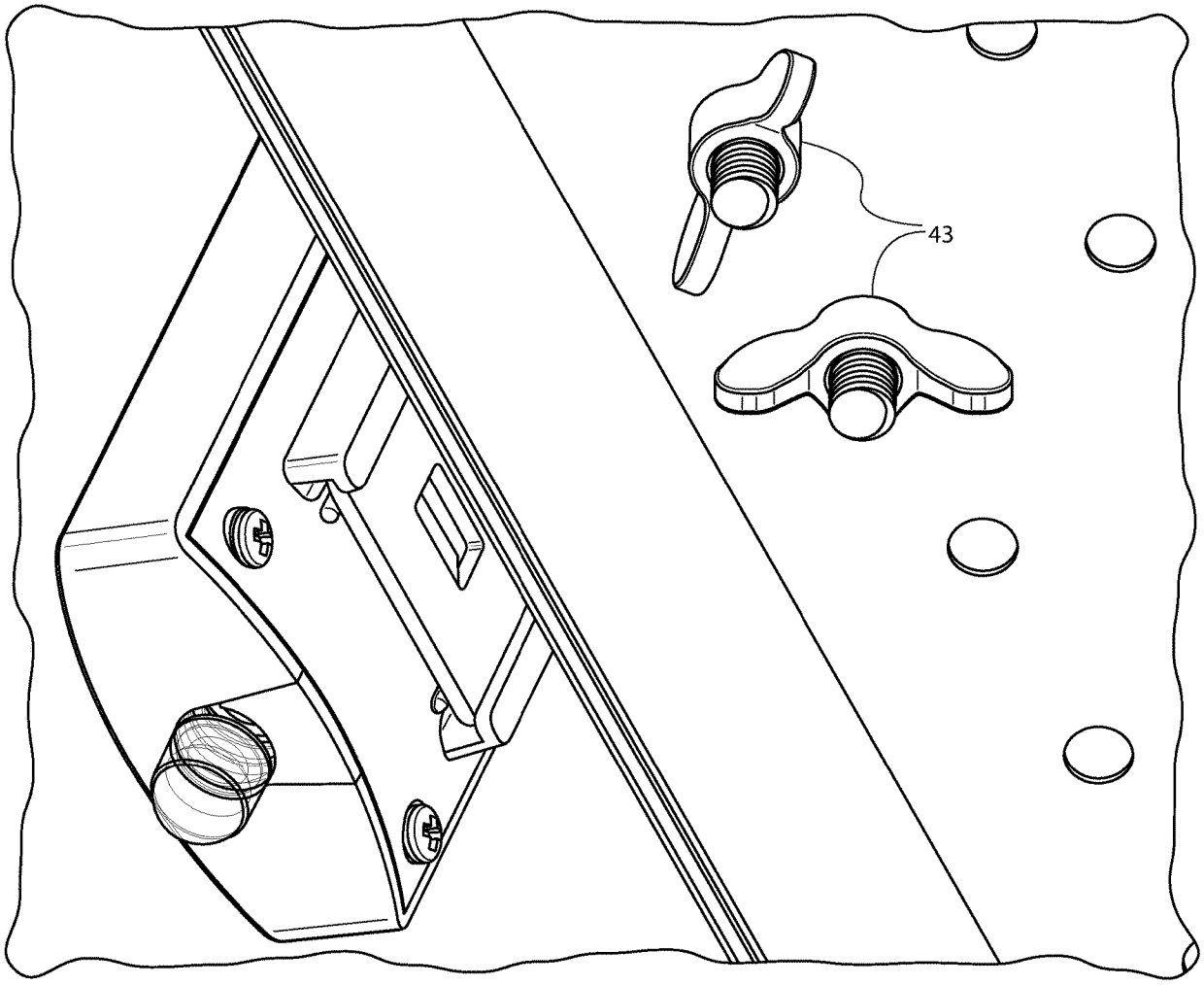
FIG. 9 is a further enlarged exploded perspective environmental view of a fragrance sampler in accordance with the first preferred embodiment of the invention viewed from a direction different than that of FIGS. 6 and 7.
Figure 10:
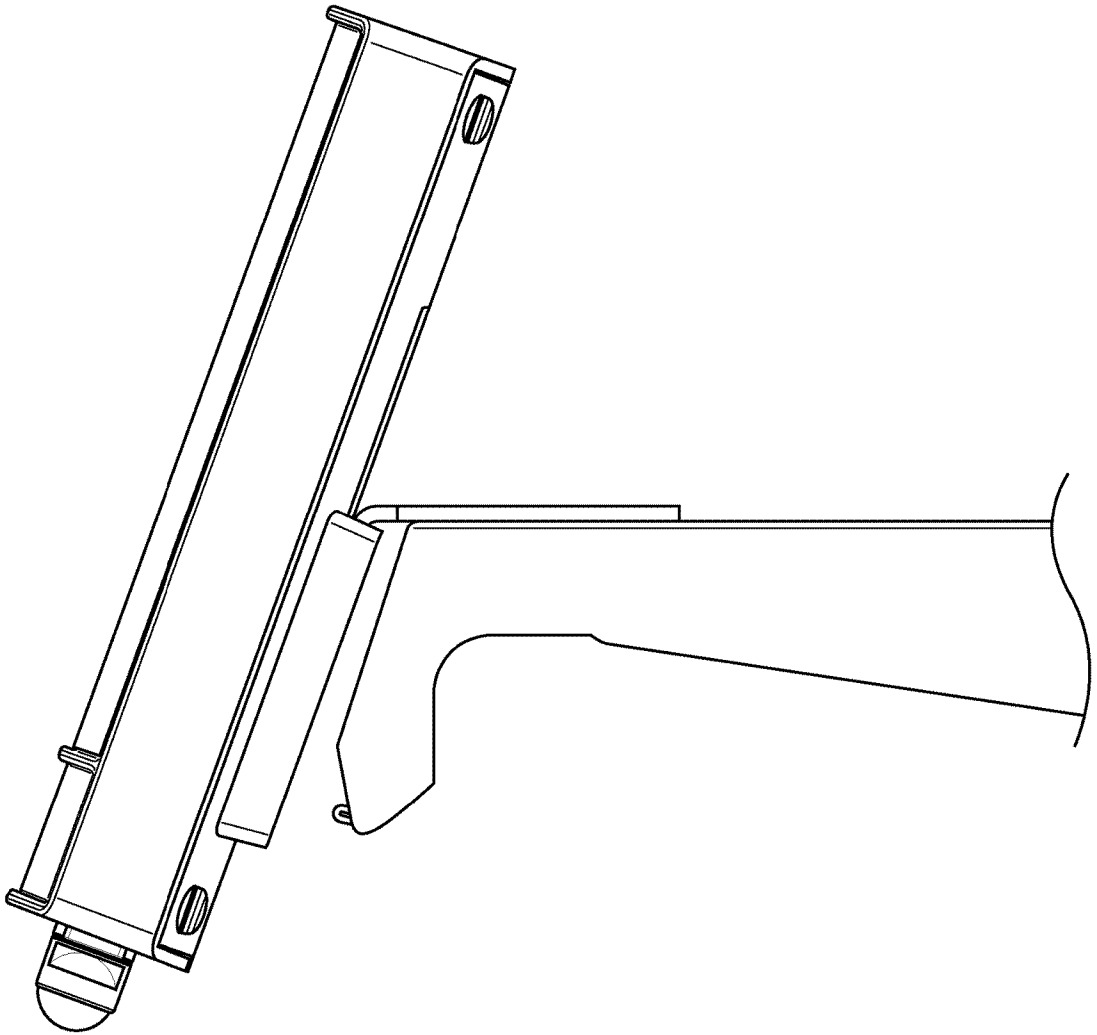
FIG. 10 is an environmental side elevation view of a fragrance sampler in accordance with the first preferred embodiment of the invention.

In a bottom wall 7 of the shell 5 there is formed an inwardly directed notch 9 for receiving a hollow cylindrical neck 11 of a roller ball gel applicator 13 having a reservoir housing 15 with a chamber for containing alcohol based fragrance liquid. As can be seen in FIG. 6, the reservoir housing 15 of the roller ball gel applicator 13 is preferably in the form of a hollow cylinder closed at a top end and having a downwardly extending hollow cylindrical neck 11 at an opposite bottom end. The display housing 1 and applicator 13 within it form a fragrance sampler.

The neck 11 has an outer diameter smaller than the outer diameter of the cylindrical reservoir 15. Mounted within a bore of the hollow neck 11 between an inner circular shoulder 18 and a retainer in the form of a circular flange 16 at the bottom end of the neck 11 is a coil spring 17 which may be made of a resilient plastic or spring steel. A roller in the form of a ball 21 also preferably made of stainless steel, but which can also be made of plastic, is rotatably mounted in the neck 11 and urged against the retainer 16 within the circular bore in the neck 11 by the spring 17. A portion of the ball 21 extends beyond the end of the neck 11. The retainer 16 has an opening with a dimension, i.e., diameter, smaller than a corresponding dimension, i.e., diameter, of the bore and a corresponding dimension of the roller ball, i.e., diameter, for preventing separation of the roller from the neck 11 and permitting rotation of the roller ball 21 within said reservoir opening while in frictional engagement with said retainer 16.

The ball 21 can be rotated when engaged by a finger for wetting the finger with the alcohol based fragrance liquid which can then be transferred to the skin on a hand or wrist from which the fragrance can be sniffed. That is, a surface of the roller ball 21, when rotated, is moved from an upward position facing the interior of the chamber of the reservoir housing 15, for receiving a coating of scented liquid, to a position facing downwardly and away from the chamber of the reservoir housing 15 for allowing engagement of the roller surface with a person's skin The ball 21 and spring 17 can be mounted within a cylindrical housing having the circular supporting flanges which housing can then be mounted within the neck 11, e.g., by a forced fit. The spring 17 has a spring constant great enough to urge the ball 21 against the retaining flange in the neck 11 with sufficient force to prevent leakage around the ball 21 but weak enough to permit the ball 21 to rotate freely in any direction when it is moved by the finger of a person with nominal pressure applied.

Referring now to FIGS. 7-10, a mounting which includes a bracket 31 is provided for affixing the display housing 1 to a store fixture, e.g., a shelf on which packaged alcohol based fragrance liquid products, ready for sale, may be displayed. Grooved rails 32 are attached to the rear cover 3 of the display housing 1 on opposite sides. The mounting and display housing with applicator inside and having a roller extending below the housing form a fragrance testing station.

The bracket 31, which in the preferred embodiment of the invention is an angle bracket, has a planar surface which is attached to the top surface of the shelf by screws 41 to which wing nuts 43 are fastened below the shelf. The grooved rails on the rear cover 3 can be slid over the spaced side edges of the bracket 31 for mounting the display housing 1 on the bracket 31 and thus affixing it to the shelf.

The roller ball gel applicator 13 is affixed to the inside surface of the back cover 3 of the display housing 1 by a holder in the form of a clamp having releasable bracket arms 30. Screws 35 are provided for fastening the cover 3 and shell 5 together. Other fastening devices may be used between the shell 5 and rear cover 3 as will be known to those skilled in the art.

The display housing 1 containing the roller ball gel applicator 13 is thus mounted to the shelf with the axis of the cylindrical reservoir 15 in a generally vertical disposition and an exposed surface of the roller ball 21 at the bottom of the roller ball gel applicator 13 and beneath the shelf. The spring 17 urges the ball 21 downwardly against a flange in the neck of the applicator for preventing leakage of the alcohol based fragrance liquid around the roller ball 21.

The fragrance sampler display housing 1 is securely mounted to the shelf and cannot readily be removed by a customer. Yet the customer has free access to sample the alcohol based fragrance liquid within the roller ball applicator 13 by placing a finger beneath the device and against the roller ball and then moving the ball 21 to thereby receive a small quantity of the alcohol based fragrance liquid on the finger which can then be dabbed onto the skin on another part of the body, e.g., a wrist or a hand.

Figure 12A:
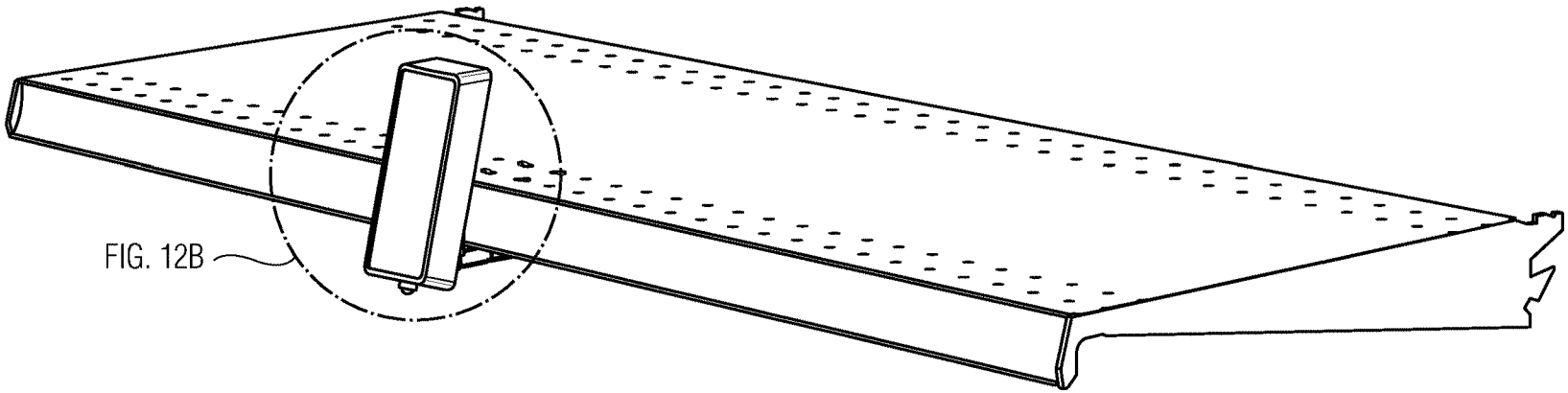
FIG. 12A is an environmental perspective view of a fragrance sampler in accordance with the second preferred embodiment of the invention.
Figure 12B:
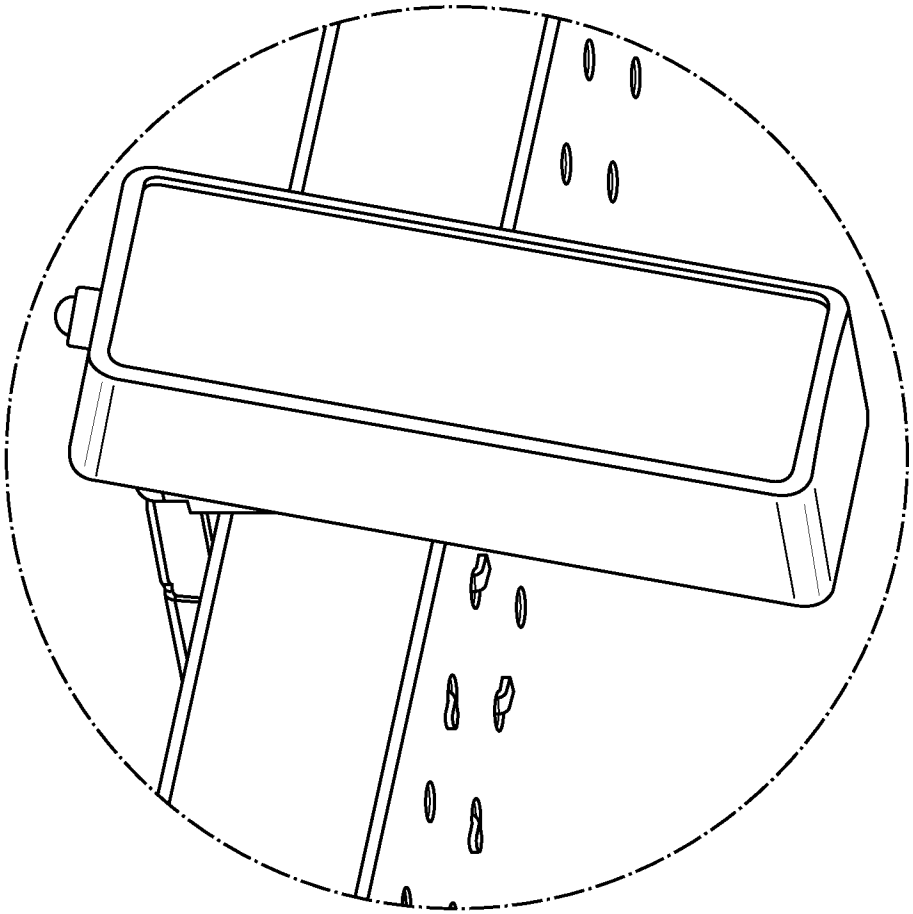
FIG. 12B is an enlarged environmental perspective view of the fragrance sampler in FIG. 12A.
Figure 13:
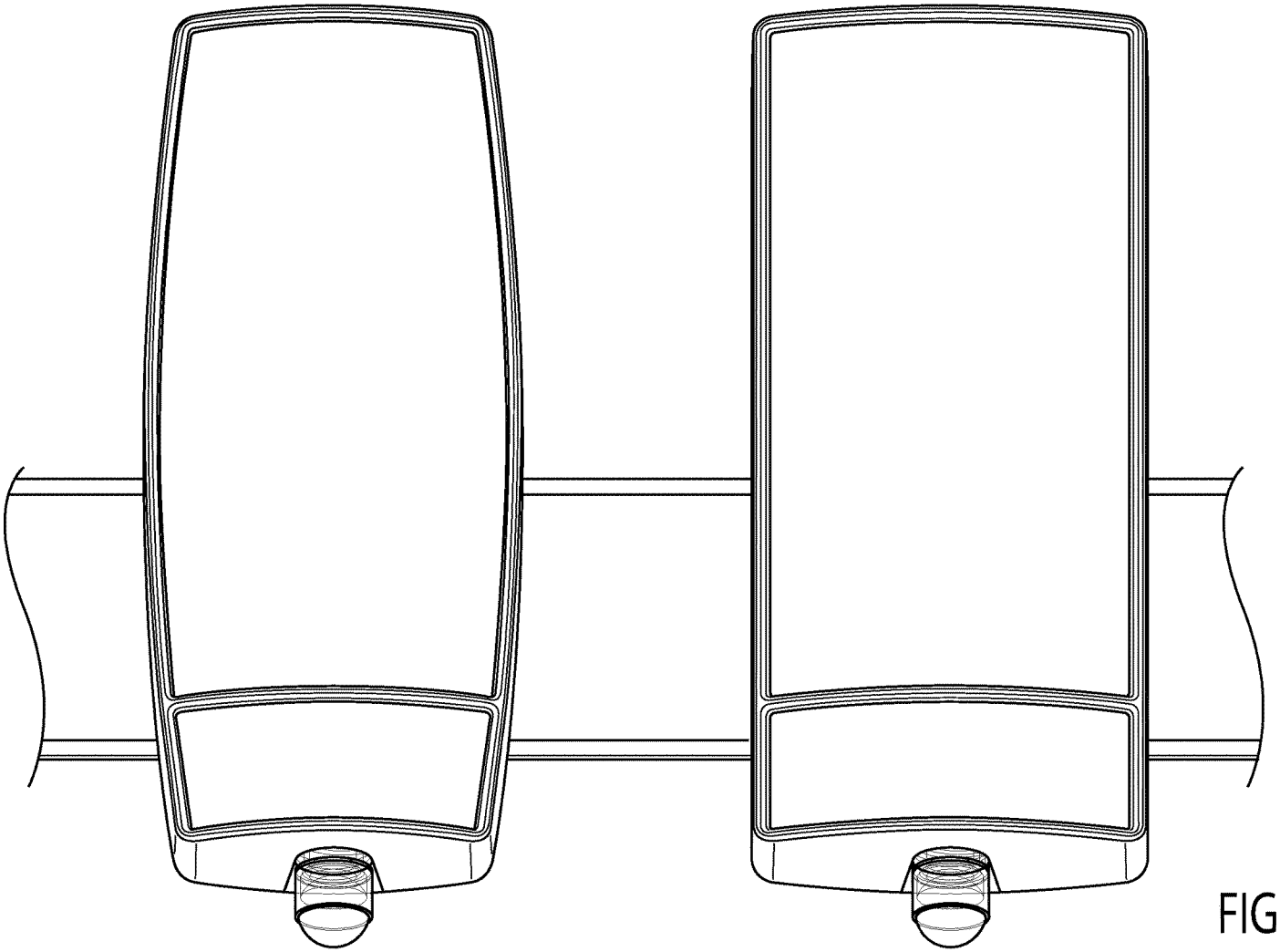
FIG. 13 is a front perspective environmental view of a fragrance sampler in accordance with the first preferred embodiment of the invention and a fragrance sampler in accordance with the second preferred embodiment of the invention.
Figure 14:
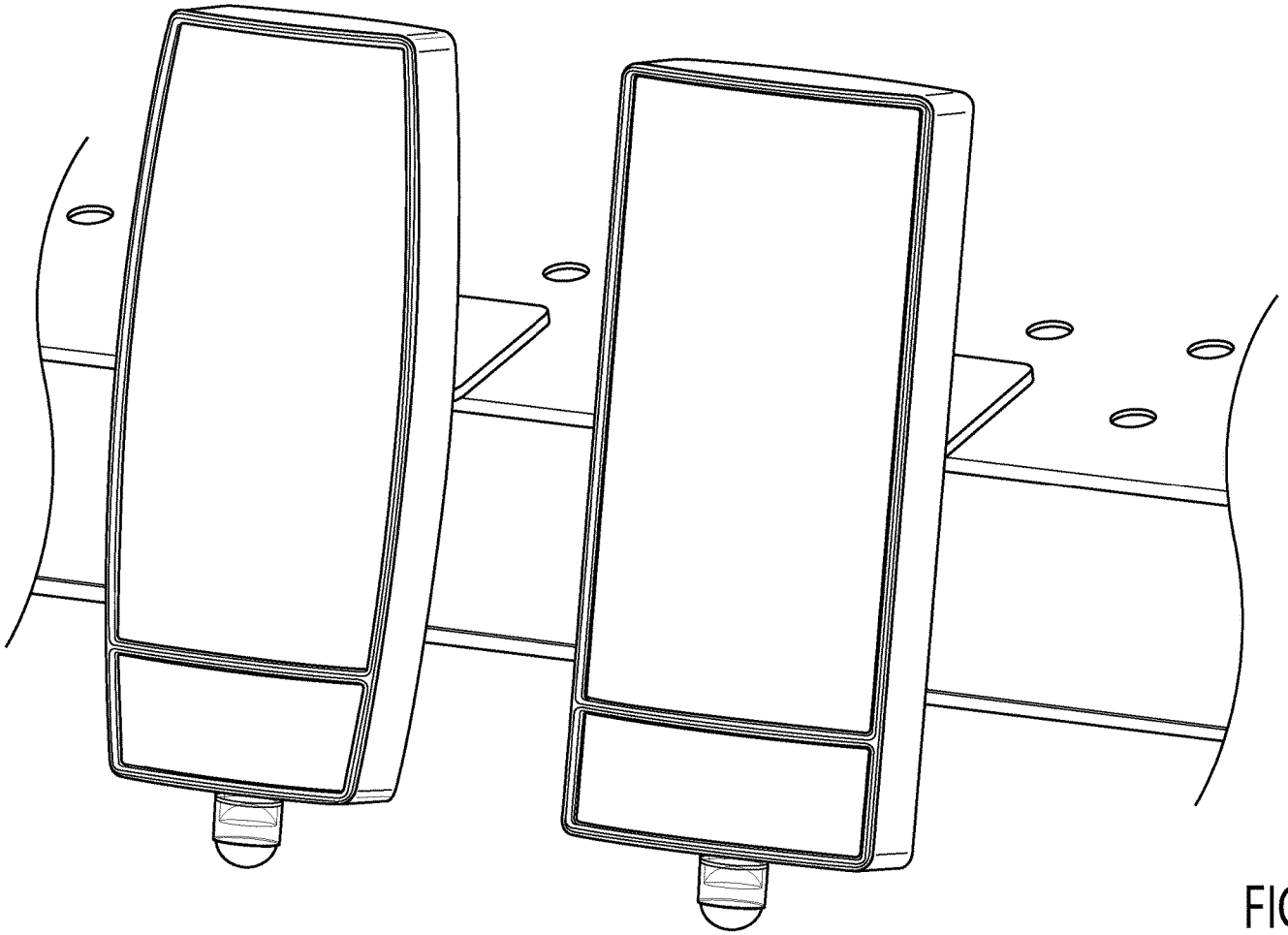
FIG. 14 is a perspective environmental view of the fragrance samplers of FIG. 13 with additional external components shown.
Figure 15:
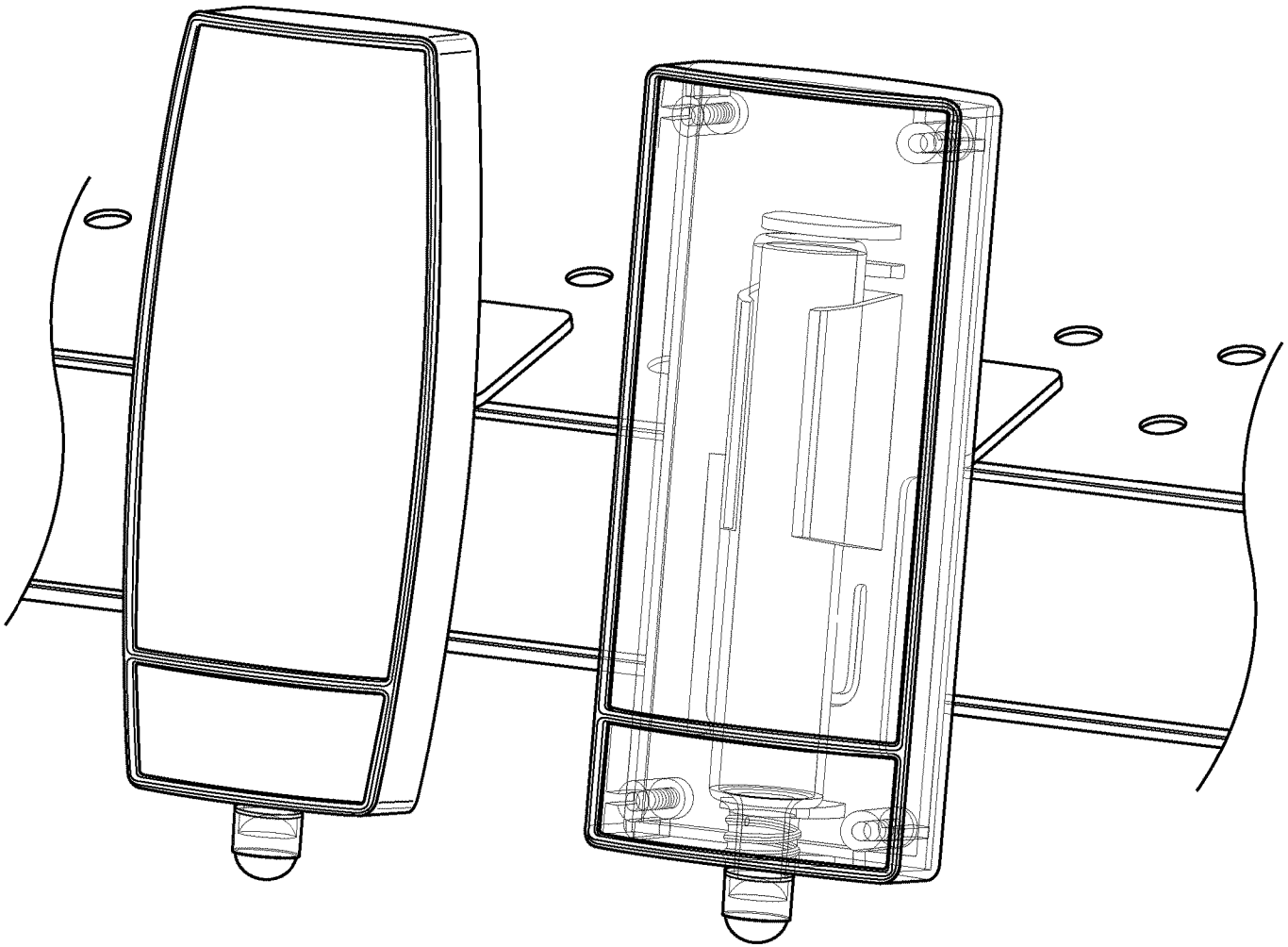
FIG. 15 is a perspective environmental view of the fragrance samplers of FIG. 14 with additional internal components shown.
Figure 16:
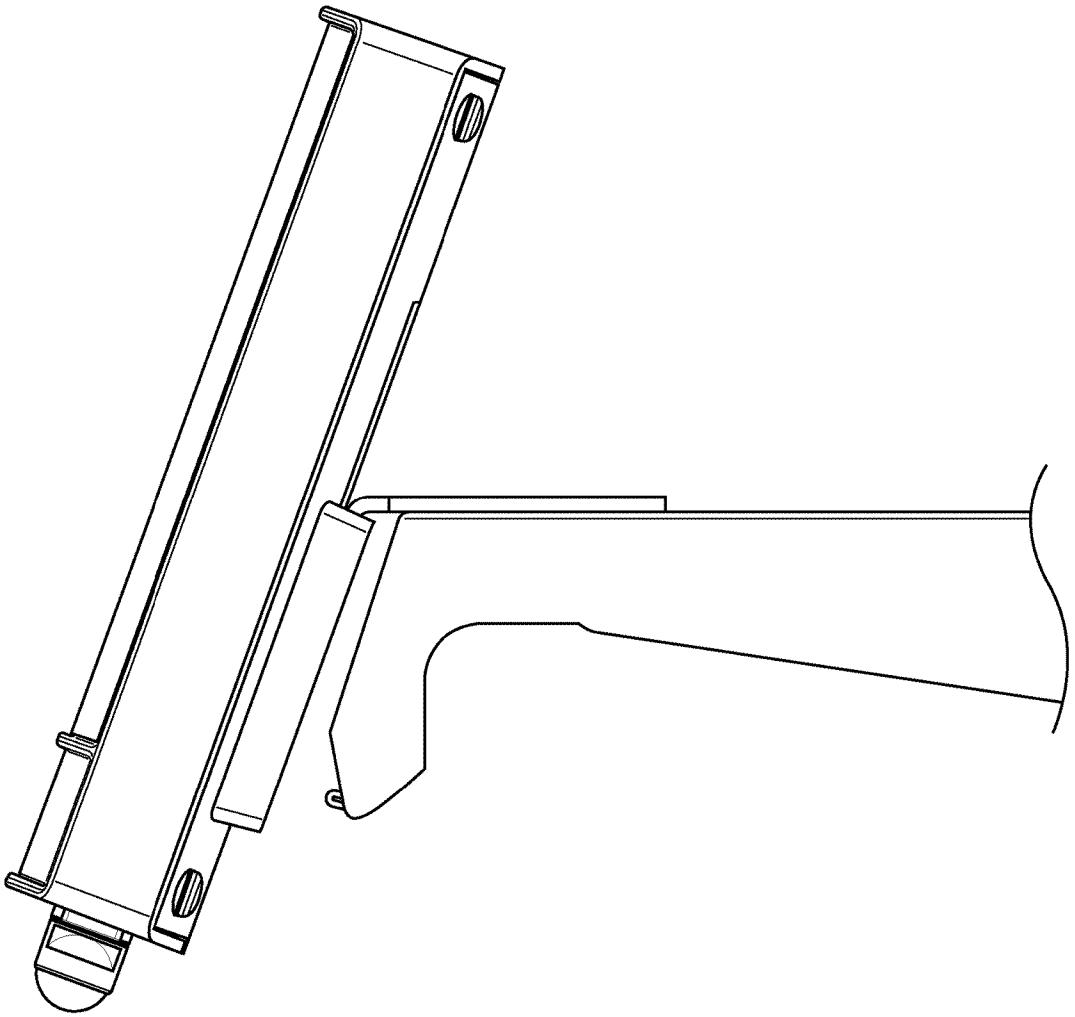
FIG. 16 is an environmental side elevation view of a fragrance sampler in accordance with the second preferred embodiment of the invention.

The display housing 1 may be mounted to the top of a shelf as shown in FIGS. 7-10 or to the underside of a shelf as shown in FIGS. 12A and 12B.

To guard against leakage, the alcohol based fragrance liquid to be sampled is preferably mixed with a high viscosity additive to increase its viscosity. The resulting flow characteristics of the gel formed by mixing the alcohol based fragrance liquid with the high viscosity additive resist a tendency of the alcohol based fragrance liquid to exit through a microscopic gap between the neck 11 and roller ball 21 under the force of gravity or for vapors emitted from the alcohol based fragrance liquid to diffuse through such a gap.

In the preferred embodiment of the invention, one or more high viscosity additives is mixed into the alcohol based fragrance liquid to form a gel sampling mixture. Each of the additives may be a rheology modifier, carbomer, or polymeric thickener, e.g., hydrophobically modified polyurethane, xanthan gum, water soluble nonionic cellulose ether, or other thickener.

The mixture of high viscosity additive and alcohol based fragrance liquid forms a gel. The preferred amount of high viscosity additive in the mixture is in the range of 0.5% to 7.0% by volume of the alcohol based fragrance liquid to be sampled. Ideally, the gel will have a viscosity in the range of 100 poise to 10,000 poise.

Figure 11:
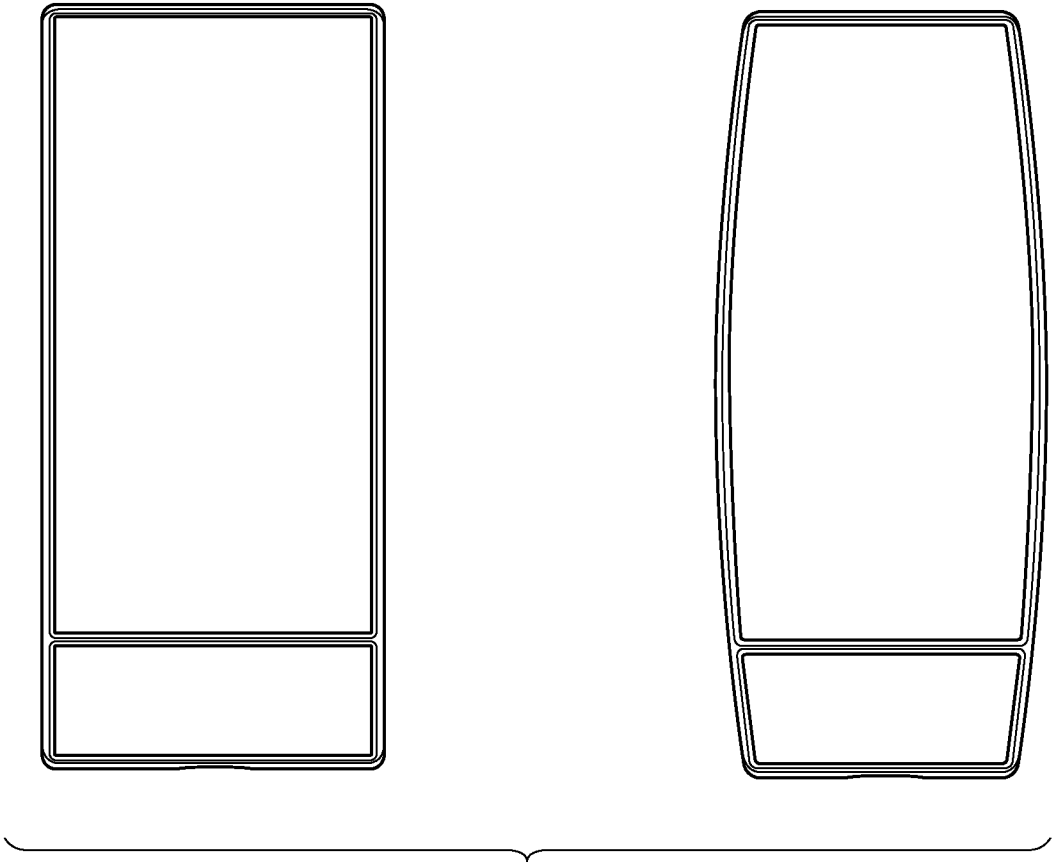
FIG. 11 is a front elevation view comparison of a fragrance sampler in accordance with the first preferred embodiment of the invention and a fragrance sampler in accordance with a second preferred embodiment of the invention.

Referring now to FIG. 11 of the drawings, there is shown a second embodiment of the invention in comparison with the first embodiment in that the display housing of the second embodiment has substantially straight side walls whereas the side walls of the first embodiment shown in FIGS. 1-10 are outwardly curved.

Referring now to FIGS. 13-16, two fragrance applicators, each containing a different alcohol based fragrance liquid, may be mounted with their display housings side by side along a shelf whereby a customer can compare different fragrances by applying small amounts of each one to different areas of the skin. The housings may be mixed. That is, an applicator with a housing of the first embodiment may be mounted adjacent an applicator with a housing of the second embodiment.

Figure 17:
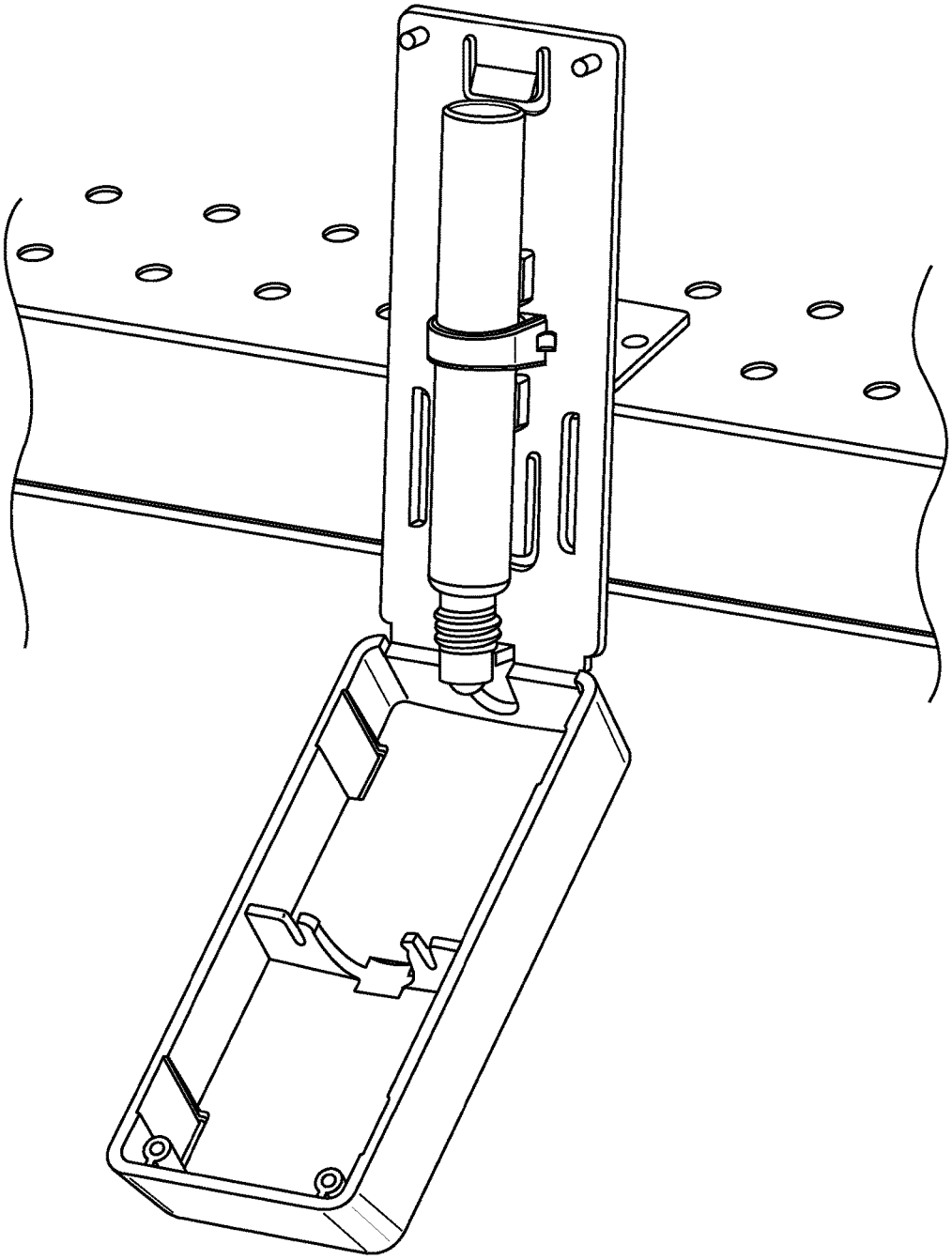
FIG. 17 is a perspective view of a fragrance sampler in accordance with the second preferred embodiment of the invention in a disposition for replacing a component thereof.

As shown in FIG. 17, the housing may have a front cover that is hinged at its bottom to the back cover 3. Instead of resilient arms, a releasable band may be used to secure the reservoir housing to the back cover 3.

Figure 18:
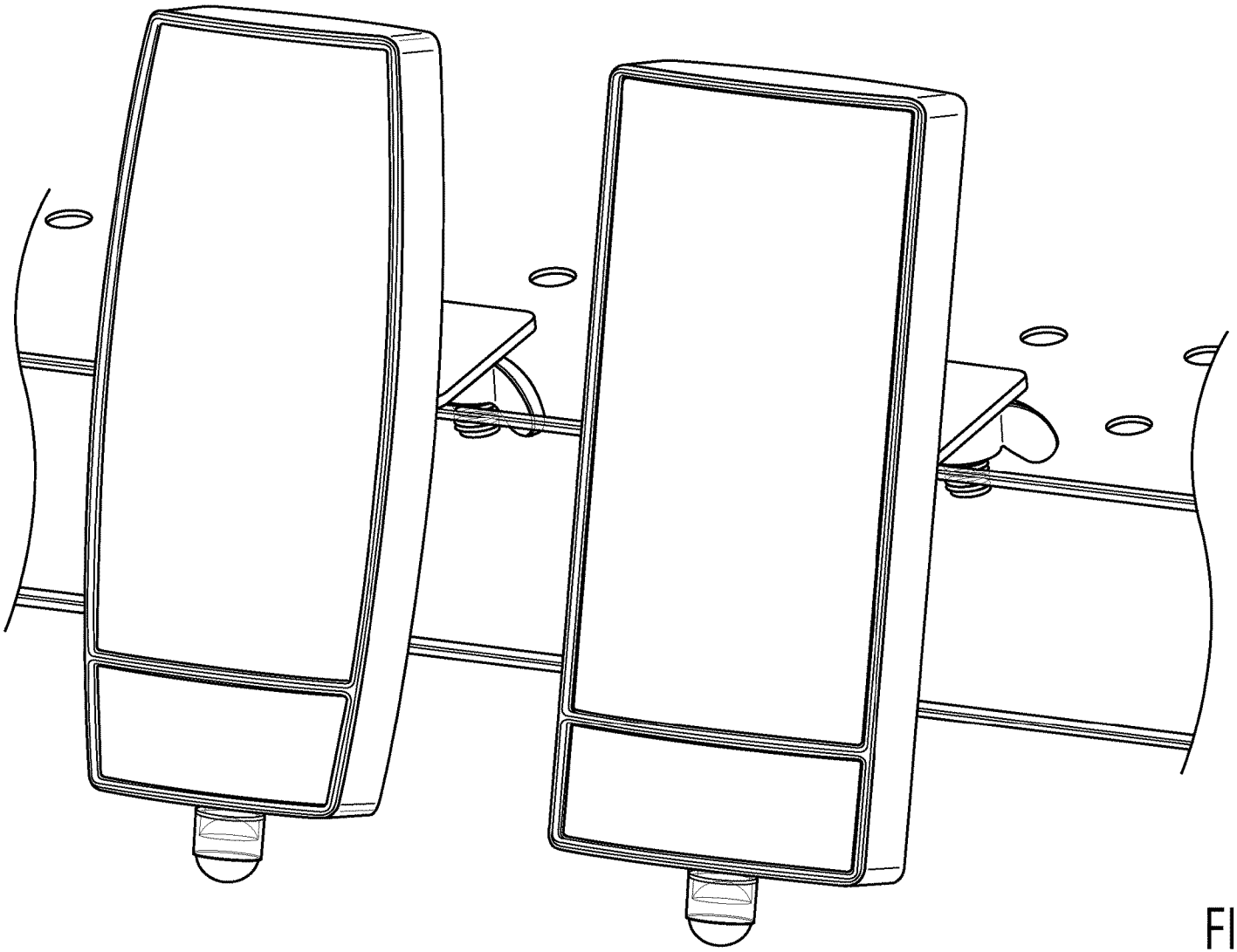
FIG. 18 is a front perspective view of fragrance samplers in accordance with the second preferred embodiment of the invention with fasters shown.
Figure 19:
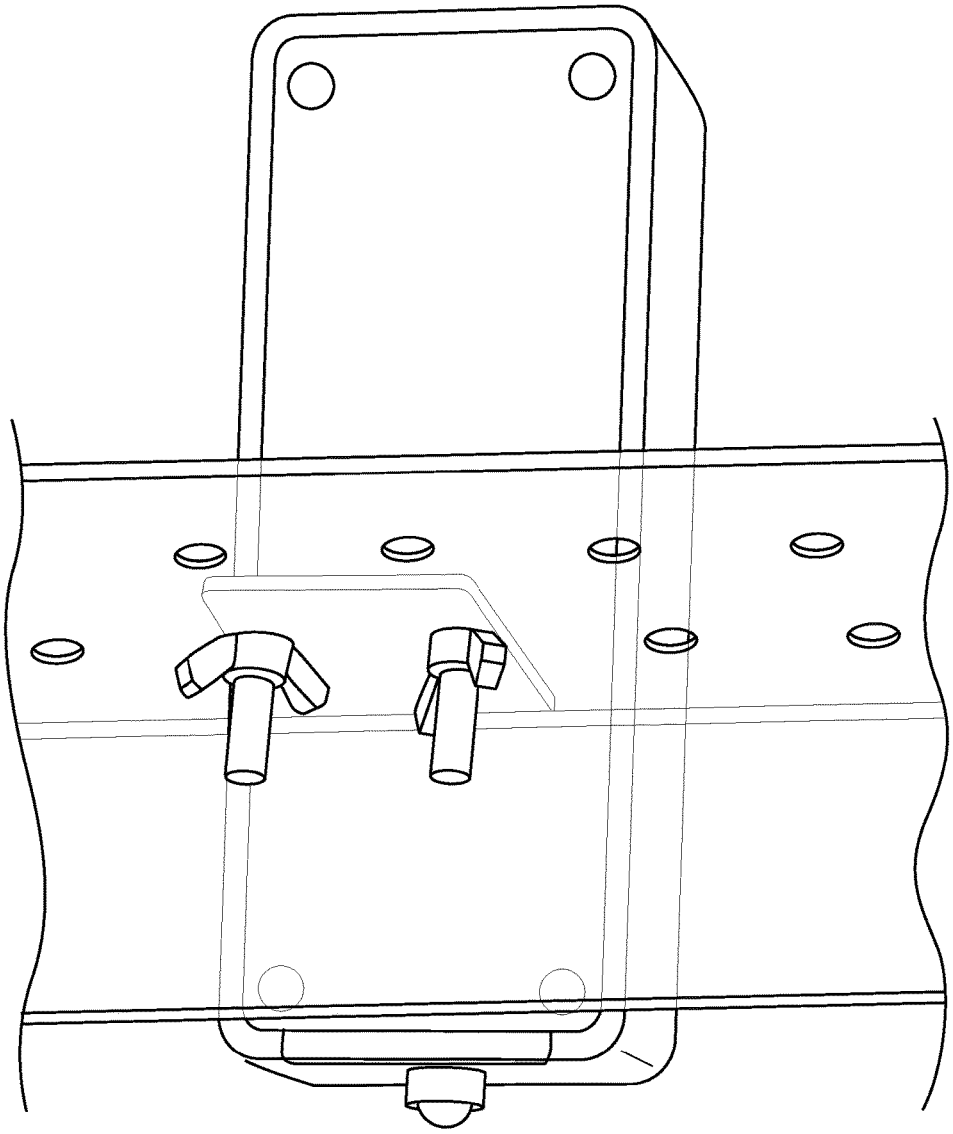
FIG. 19 is a rear perspective view of the fragrance samplers of FIG. 18.

Referring to FIGS. 18 and 19, for apertured shelves, conventional angle brackets can be used to mount the applicators in a store environment with screws and wing nuts thereby facilitating removal and replacement of the applicators.

Figure 20:
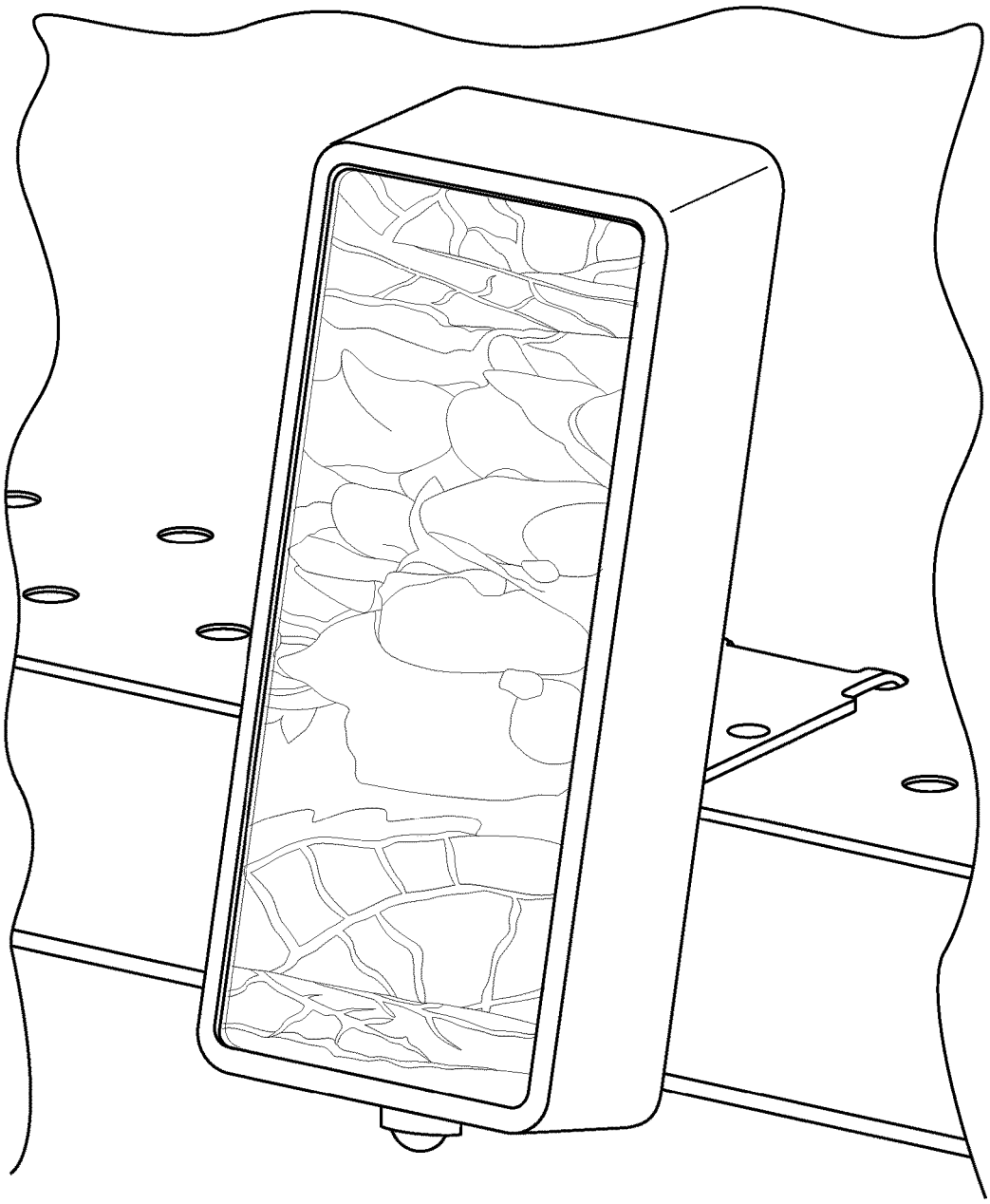
FIG. 20 is an environmental perspective view of a fragrance testing station in accordance with the second preferred embodiment of the invention having display graphics.
Figure 21:
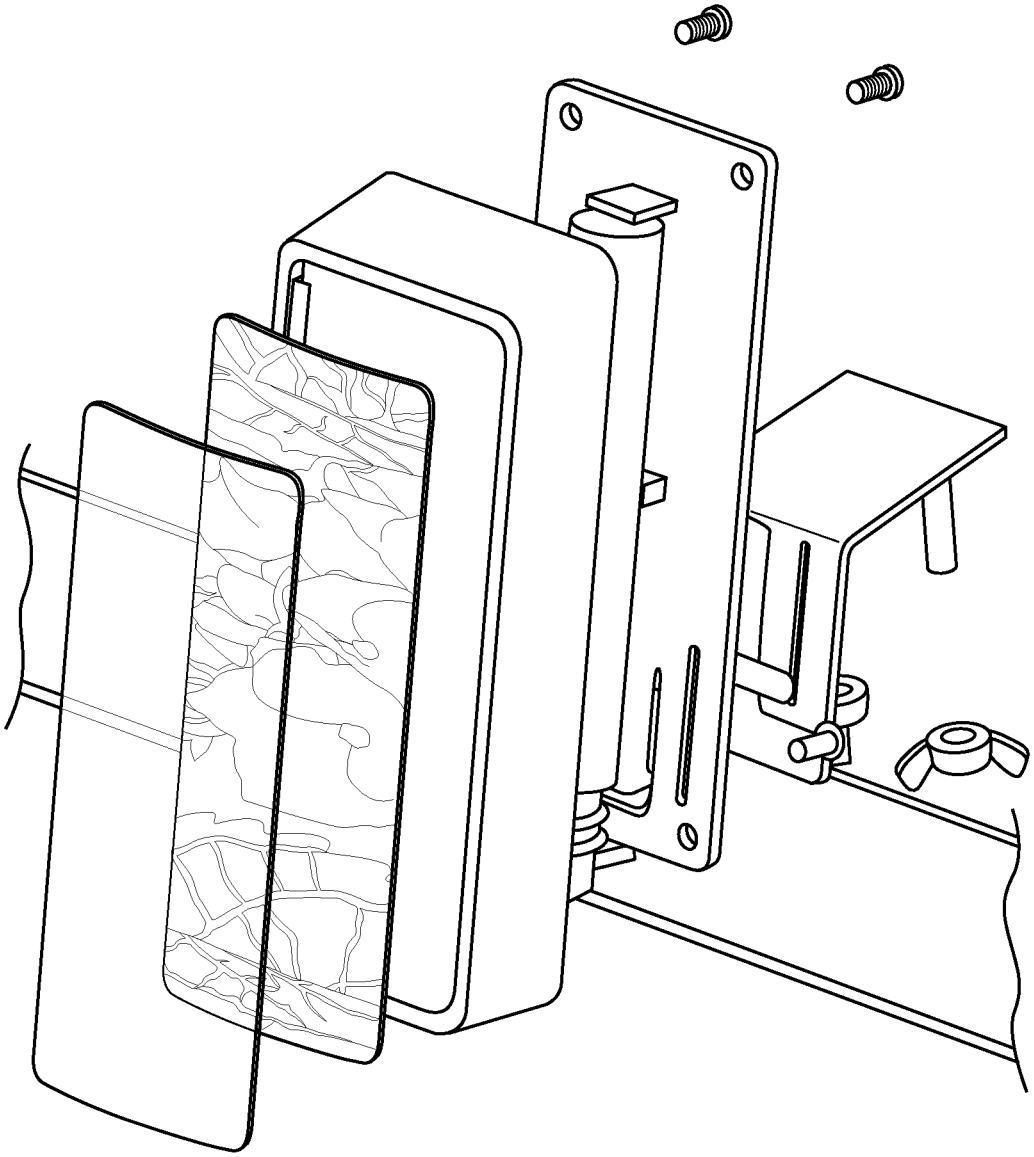
FIG. 21 is an exploded perspective view of the fragrance testing station of FIG. 20.
Figure 22:
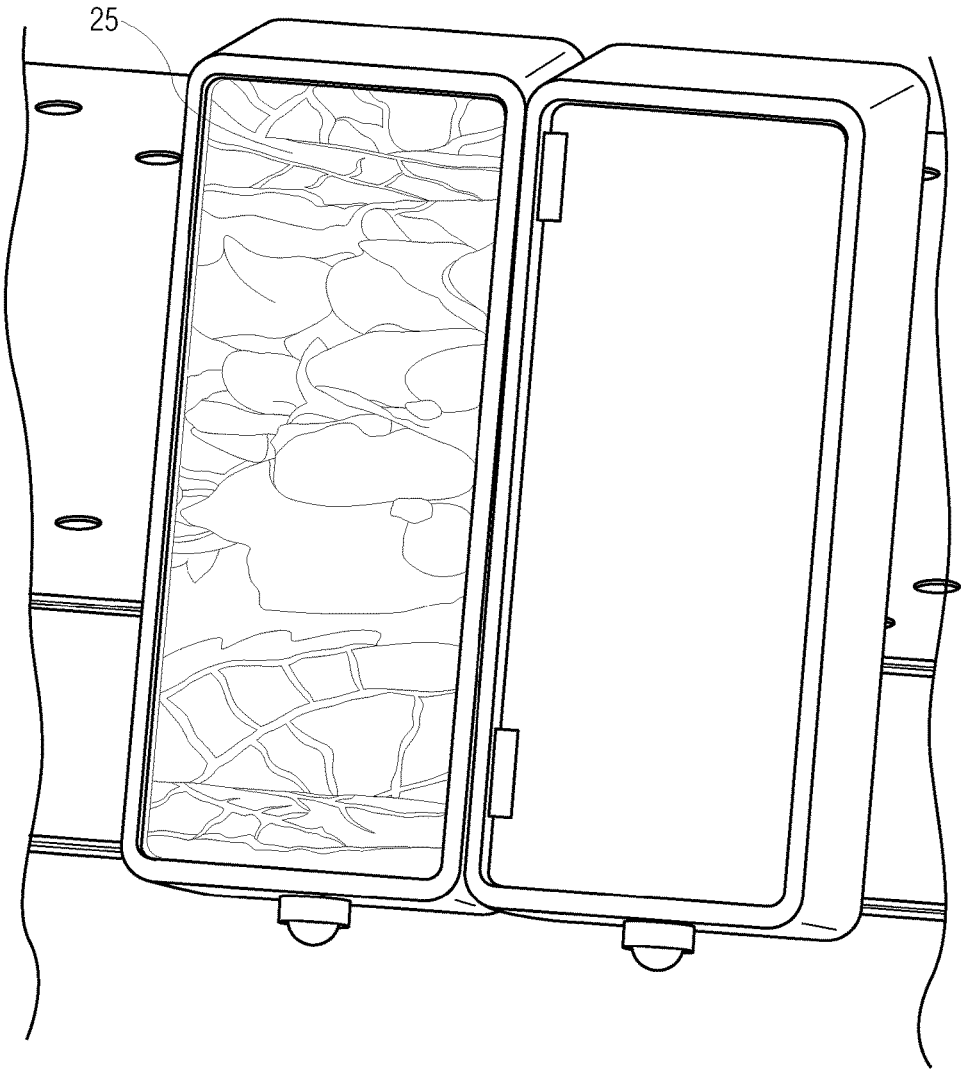
FIG. 22 is an environmental perspective view of a fragrance testing station with two fragrance samplers, one of which has display graphics.
Figure 23:
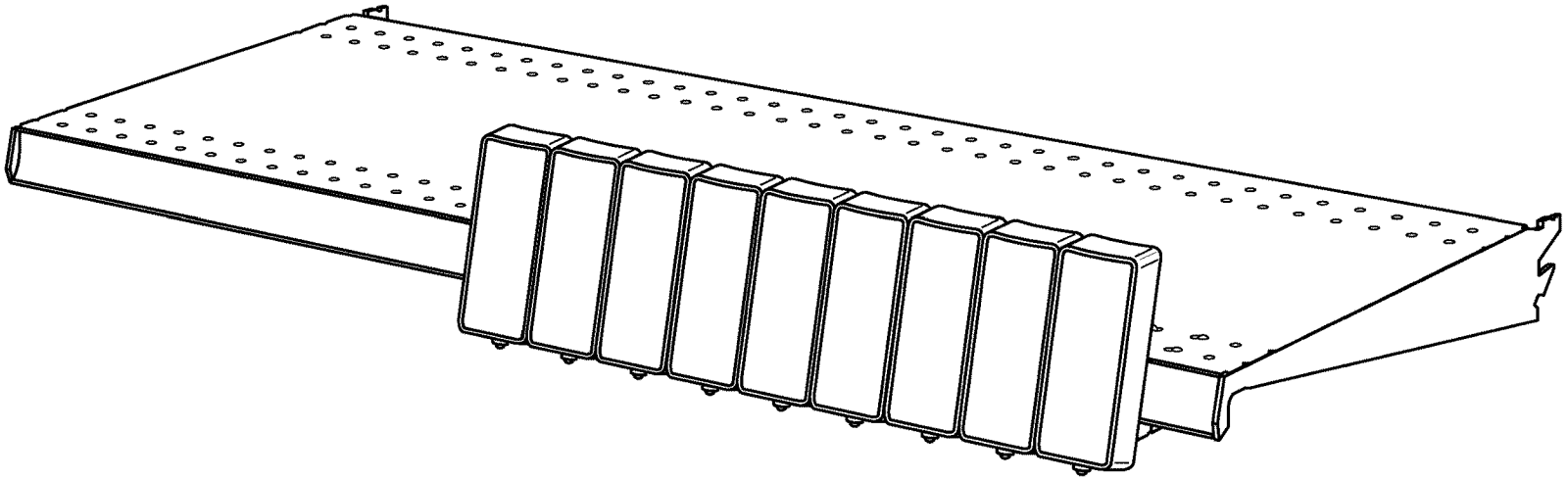
FIG. 23 is an environmental perspective view of a fragrance testing station with multiple fragrance samplers in accordance with the second preferred embodiment of the invention.

Referring now to FIGS. 20-22, a graphic design printed on a rectangular sheet of paper stock or plastic material may be affixed to or mounted on an outer front surface 27 of the shell 5 and then covered by a removably attachable transparent panel, i.e., clear lens 29 which may also be made of an injection molded plastic.

It is to be appreciated that the foregoing disclosure is of a preferred embodiment of the invention to which modifications and alterations may be made without departing from the spirit and scope of the invention. For example, connectors for mounting the alcohol based fragrance liquid sampling device on a shelf or to the store fixture other than the bracket 31 herein described may be employed Any number of applicators may be mounted side-by-side to construct a fragrance testing station.

What is claimed is:

1. A fragrance testing station at which shoppers in a store can experience by applying directly to their skin a fragrance product comprising a perfume, cologne, eau de toilette (EDT), or other scented liquid having the same aroma as a scented liquid sold in the store, said testing station comprising, a sampling mixture comprising said scented liquid and an odorless high viscosity additive for imparting to said sampling mixture a viscosity greater than the viscosity of said scented liquid, a reservoir housing having a chamber for containing said sampling mixture, said chamber having a bottom with an opening through which said sampling mixture can exit under force of gravity, a roller rotatably mounted in said reservoir housing adjacent said bottom opening, so that upon rotation of said roller, a surface of said roller is moved from an upward position facing the interior of said chamber for receiving a coating of said scented liquid to a position facing downwardly away from said chamber for allowing engagement of said surface with a person's skin, a retainer mounted on said housing at said opening, said retainer having an opening with a dimension smaller than a corresponding dimension of said opening and a corresponding dimension of said roller for preventing separation of said roller from said housing and permitting rotation of said roller within said reservoir opening while in frictional engagement with said retainer, said high viscosity additive imparting to said sampling mixture a viscosity greater than the viscosity of said scented liquid for preventing leakage of said sampling mixture through a space between said roller and said retainer, and a mounting for affixing said reservoir housing to a fixture in said store with the bottom of said reservoir opening proximate a floor of said store and a top of said reservoir opposite said bottom of said reservoir and distal from said floor, whereby said sampling mixture is urged against said surface of said roller by gravity when in said upper position for imparting a coating of said sampling mixture to said surface of said roller, and at least a portion of said coating can be applied to the skin by rotating said roller to said downwardly facing position.

2. A fragrance testing station according to claim 1 further comprising a spring mounted in between a surface within said reservoir housing and said roller for urging said roller against said retainer.

3. A fragrance testing station according to claim 1 wherein said high viscosity additive is selected from the group consisting of rheology modifier, carbomer, hydrophobically modified polyurethane, xanthan gum, water soluble nonionic cellulose ethers, and polymeric thickener.

4. A fragrance testing station according to claim 1 wherein said high viscosity additive in said sampling mixture is in the range of 0.5% to 7.0% by volume of said scented liquid.

5. A fragrance testing station according to claim 1 wherein a viscosity of said sampling mixture is in the range of 100 poise to 10,000 poise.

6. A fragrance testing station according to claim 1 wherein said roller comprises a spherical roller.

7. A fragrance testing station according to claim 6 wherein said opening in said retainer is circular.

8. A fragrance testing station according to claim 1 wherein said mounting comprises a holder for said reservoir, said holder comprising a releasable clamp for allowing removal and replacement of said reservoir in said mounting.

9. A fragrance testing station according to claim 8 wherein said mounting comprises a bracket having a surface complimentary to a surface of said fixture in said store, and a fastener for fixing said mounting to said fixture.

10. A fragrance testing station according to claim 8 wherein said mounting comprises an enclosure in which said releasable clamp is disposed for hiding a portion of said reservoir therein from view.

11. A fragrance testing station according to claim 10 wherein said enclosure has a bottom wall with an aperture through which said roller is extendable from said reservoir whereby said roller is accessible for sampling said sampling mixture.

12. A fragrance testing station according to claim 10 further comprising a transparent panel removably attachable to said mounting over an outer surface of a front wall of said enclosure for capturing between said outer surface of said front wall and said transparent panel a graphical design or picture.

* * * * *